US009520209B2

(12) United States Patent
Chiu et al.

(10) Patent No.: US 9,520,209 B2
(45) Date of Patent: Dec. 13, 2016

(54) FLAME RETARDANT TWIN AXIAL CABLE

(71) Applicant: 3M INNOVATIVE PROPERTIES COMPANY, St. Paul, MN (US)

(72) Inventors: Chuang-Wei Chiu, Austin, TX (US); Douglas B. Gundel, Cedar Park, TX (US); Haohao Lin, Austin, TX (US); Mark T. Palmer, New Ulm, MN (US); Eumi Pyun, Austin, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 14/648,461

(22) PCT Filed: Feb. 20, 2013

(86) PCT No.: PCT/US2013/026783
§ 371 (c)(1),
(2) Date: May 29, 2015

(87) PCT Pub. No.: WO2014/098930
PCT Pub. Date: Jun. 26, 2014

(65) Prior Publication Data

US 2015/0302952 A1 Oct. 22, 2015

Related U.S. Application Data

(60) Provisional application No. 61/738,083, filed on Dec. 17, 2012.

(51) Int. Cl.
*H01B 7/295* (2006.01)
*H01B 3/44* (2006.01)
(Continued)

(52) U.S. Cl.
CPC ..... *H01B 7/295* (2013.01); *H01B 3/10* (2013.01); *H01B 3/307* (2013.01); *H01B 3/441* (2013.01);
(Continued)

(58) Field of Classification Search
CPC ..... H01B 7/295; H01B 7/0807; H01B 3/307; H01B 3/10; H01B 3/442
(Continued)

(56) References Cited

U.S. PATENT DOCUMENTS 4,674,822 A * 6/1987 Hall ..... H01R 4/2404 174/36
5,883,178 A * 3/1999 Ohmoto ..... C08K 3/0033 524/404
(Continued)

FOREIGN PATENT DOCUMENTS

CA 2158498 5/1996
EP 0962945 8/1999
(Continued)

OTHER PUBLICATIONS

International Search Report for PCT International Application No. PCT/US2013/026783, mailed on Oct. 30, 2013, 3 pages.

*Primary Examiner* — Timothy Thompson
*Assistant Examiner* — Charles Pizzuto
(74) *Attorney, Agent, or Firm* — Robert S. Moshrefzadeh

(57) ABSTRACT

A cable includes a plurality of conductor sets. Each conductor set extending along a length of the cable and includes two or more insulated conductors, each insulated conductor including a central conductor surrounded by a dielectric material that includes polyolefin, a brominated flame retardant, and antimony trioxide. First and second conductive shielding films are disposed on opposite first and second sides of the conductor set, including cover portions and pinched portions arranged such that, in transverse cross section, the cover portions of the first and second shielding films in combination substantially surround the conductor set, and the pinched portions of the first and second shielding films in combination form pinched portions of the conductor set on each side of the conductor set. The cable includes an adhesive layer bonding the first shielding film to the second shielding film in the pinched portions of the conductor set.

13 Claims, 4 Drawing Sheets

(51) Int. Cl.

| | |
|---|---|
| ***H01B 3/10*** | (2006.01) |
| ***H01B 7/08*** | (2006.01) |
| ***H01B 3/30*** | (2006.01) |
| *H01B 11/20* | (2006.01) |

(52) U.S. Cl.
CPC ..... *H01B 3/442* (2013.01); *H01B 7/0807* (2013.01); *H01B 11/203* (2013.01)

(58) Field of Classification Search
USPC ..... 174/106 R
See application file for complete search history.

(56) References Cited

U.S. PATENT DOCUMENTS

| | | | | |
|---|---|---|---|---|
| 9,119,292 | B2 | 8/2015 | Gundel | |
| 9,305,678 | B2 | 4/2016 | Shimada et al. | |
| 2004/0011552 | A1* | 1/2004 | McKenney | H01B 7/0009 174/117 F |
| 2006/0134416 | A1 | 6/2006 | Kubo | |
| 2006/0237219 | A1* | 10/2006 | Glew | H01B 11/06 174/113 C |
| 2007/0066710 | A1 | 3/2007 | Peters | |
| 2007/0267213 | A1* | 11/2007 | Clem | G01R 1/06788 174/78 |
| 2011/0011617 | A1* | 1/2011 | Walid | H01B 7/0869 174/116 |
| 2012/0037396 | A1* | 2/2012 | Gu | H01B 7/295 174/110 AR |
| 2012/0090866 | A1 | 4/2012 | Gundel | |
| 2012/0090872 | A1 | 4/2012 | Gundel | |
| 2012/0090873 | A1 | 4/2012 | Gundel | |
| 2012/0097421 | A1 | 4/2012 | Gundel | |
| 2014/0031474 | A1* | 1/2014 | Kogo | H01B 7/295 524/373 |

FOREIGN PATENT DOCUMENTS

| | | |
|---|---|---|
| JP | 10-255551 | 9/1998 |
| JP | 3131110 | 1/2001 |
| JP | 2003-346563 | 12/2003 |
| JP | 2007-280762 | 10/2007 |
| JP | 2010-211937 | 9/2010 |
| WO | WO 2005-062315 | 7/2005 |
| WO | WO 2007-007663 | 1/2007 |
| WO | WO 2012-033053 | 3/2012 |

* cited by examiner

FLAME RETARDANT TWIN AXIAL CABLE

TECHNICAL FIELD

The present disclosure relates generally to shielded electrical cables for the transmission of electrical signals. In particular, the present invention relates to flame retardant shielded twin axial electrical cables that can provide high speed electrical properties.

BACKGROUND

Electrical cables for transmission of electrical signals are well known, including, for example, shielded electrical cables that can be mass-terminated and provide high speed electrical properties. Such cables need to meet a host of requirements including suitable signal transmission properties, manufacturability, and safety requirements including, for example, VW-1 flame retardancy standards. In view of the advancements in high speed electrical and electronic components, a continuing need exists for electrical cables that are capable of transmitting high speed signals, meet flame retardancy standards, are cost-effective, readily manufactured, and can be used in a large number of applications.

SUMMARY

The present disclosure provides a cable that includes a plurality of conductor sets, each conductor set extending along a length of the cable. Each conductor set includes two or more insulated conductors, and each insulated conductor has a central conductor surrounded by a dielectric material. The dielectric material includes 100 parts by weight of polyolefin, 18 to 40 parts by weight of a brominated flame retardant, and 12 to 20 parts by weight of antimony trioxide. The brominated flame retardant is selected from the group consisting of decabromodiphenylethane, N,N'-ethylene-bis (tetrabromophthalimide), poly(pentabromobenzyl acrylate), and mixtures thereof. First and second conductive shielding films are disposed on opposite first and second sides of the conductor set. The first and second conductive shielding films include cover portions and pinched portions arranged such that, in transverse cross section, the cover portions of the first and second shielding films in combination substantially surround the conductor set. The pinched portions of the first and second shielding films in combination form pinched portions of the conductor set on each side of the conductor set. An adhesive layer bonds the first shielding film to the second shielding film in the pinched portions of the conductor set.

DETAILED DESCRIPTION

Figure 1:
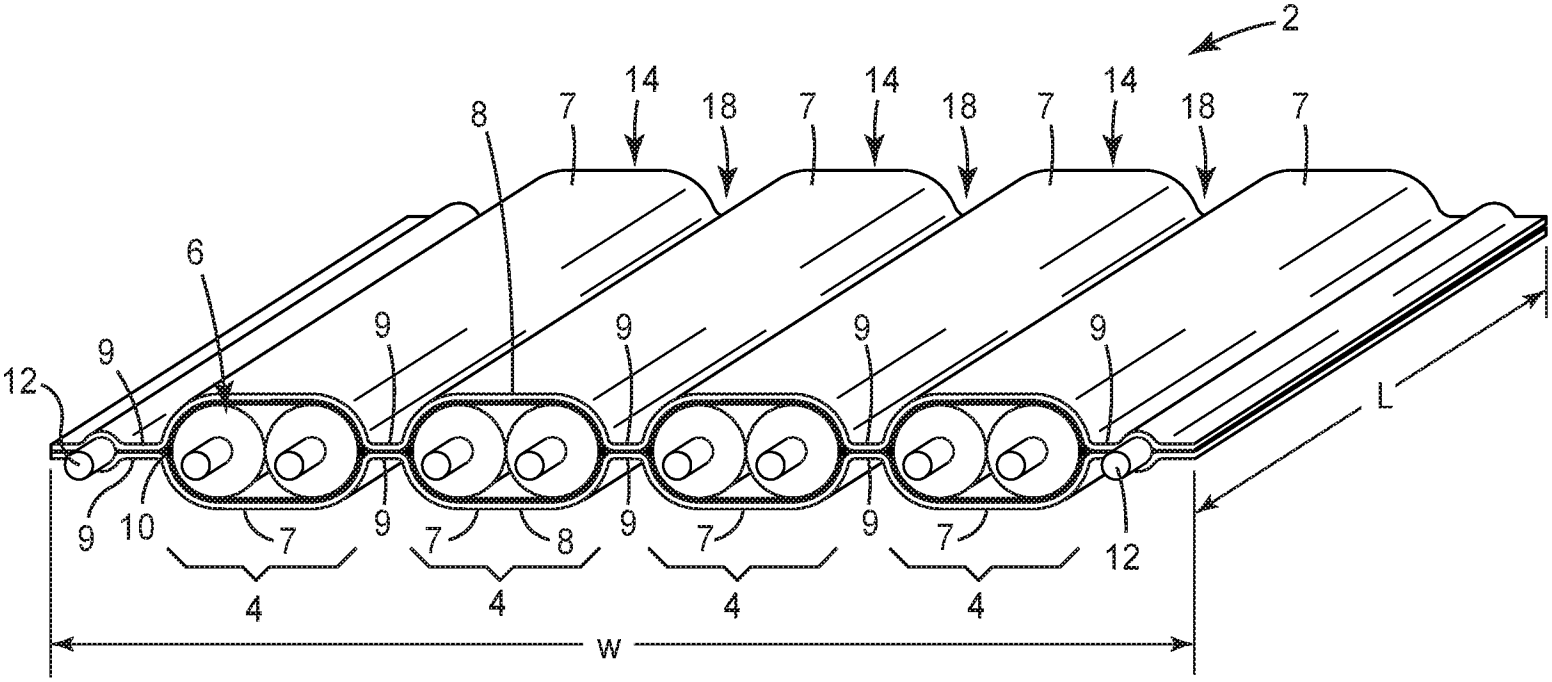
FIG. 1 is a perspective view of an exemplary embodiment of a shielded electrical cable according to an aspect of the present disclosure.

In the following detailed description, reference is made to the accompanying drawings that form a part hereof. The accompanying drawings show, by way of illustration, specific embodiments in which the invention may be practiced. It is to be understood that other embodiments may be utilized, and structural or logical changes may be made without departing from the scope of the present invention. The following detailed description, therefore, is not to be taken in a limiting sense, and the scope of the invention is defined by the appended claims.

The present disclosure provides a shielded electrical cable that includes longitudinal insulated conductors. Each longitudinal insulated conductor has a central conductor surrounded by a dielectric material extending radially outwards from the central conductor. The dielectric material includes polyolefin, a flame retardant brominated compound, and antimony trioxide. The dielectric material can be formulated to provide flame retardant insulated conductors, and the flame retardant insulated conductors can be useful for manufacture of shielded electrical cables that can pass burning characteristic tests (e.g., FV-2/VW-1 test method, Section 9.4 in UL Standards for Safety for Wire and Cable Test Methods, UL 2556, Second Edition, dated Jul. 19, 2007).

It is desirable to use a dielectric material that can provide suitable electrical characteristics (e.g., low insertion loss). The dielectric material is preferably to have low loss tangent not detrimental to desired electrical characteristic of the shielded electrical cable.

The polyolefin of the dielectric material can include a polymer or copolymer based on ethylene and/or propylene. In some embodiments the polyolefin can be a high-density polyethylene ("HDPE") copolymer, preferably a copolymer of ethylene with at least one 1-olefin containing from 3 to 12 carbon atoms, optionally with at least one diene containing from 4 to 20 carbon atoms. A preferred HDPE composition includes greater than 99.5% ethylene repeat units and few if any comonomers. A commercially available HDPE material that fits in the above range is DGDL 3364 NT, available from Dow, Inc. (Midland, Mich.), described by the manufacturer as HDPE-stabilized with metal deactivator.

In some other embodiments, the polyolefin can be a copolymer of 90% polypropylene and 10% ethylene and/or at least one 1-olefin containing from 4 to 12 carbon atoms, or blend thereof. A preferred 1-olefin is 1-hexene. A suitable example of a commercially available propylene/ethylene copolymer is PRO-FAX EP315J, available from Lyondell-Basell Industries (Houston, Tex.), which can include up to 5 weight percent of a stabilizer material.

In some embodiments, the polyolefin can be a blend of a suitable HDPE and a suitable propylene/ethylene copolymer. For example, the HDPE and propylene/ethylene copolymer can be blended in a weight ratio of 50:50 or less, such as, e.g., 60:40, 70:30, 80:20, or even 90:10. Based on, e.g., the cable configuration, the HDPE and propylene/ethylene copolymer can be blended in a weight ratio of 50:50 or more, such as, e.g., 40:60, 30:70, 20:80, or even 10:90.

The dielectric material includes a brominated flame retardant dispersed in the polyolefin. Suitable brominated flame retardants can include any of decabromodiphenylethane ("DBDPE"), N,N'-ethylene-bis(tetrabromophthalimide)

("EBTBP"), poly(pentabromobenzyl acrylate) ("poly-PBBA"), and mixtures thereof. A preferred brominated flame retardant is DBDPE.

In some embodiments, the dielectric material can include brominated flame retardant in an amount up to 40 parts by weight, up to 35 parts by weight, or even up to 30 parts by weight relative to 100 parts by weight of polyolefin in the dielectric material. Other amounts may be selected as suitable for the intended cable configuration. The dielectric material can include brominated flame retardant in amount of at least 18 parts by weight, at least 20 parts by weight, or even at least 25 parts by weight relative to 100 parts by weight of polyolefin in the dielectric material. In some embodiments, the dielectric material can include an amount of brominated flame retardant in a range from 18 parts by weight to 40 parts by weight, from 20 parts by weight to 35 parts by weight, or even from 25 parts by weight to 30 parts by weight, relative to 100 parts by weight of polyolefin in the dielectric material.

The dielectric material includes antimony trioxide ($Sb_2O_3$) dispersed in the polyolefin. In some embodiments, the dielectric material includes $Sb_2O_3$ in an amount up to amount up to 30 parts by weight, up to 20 parts by weight, or even up to 12 parts by weight relative to 100 parts by weight of polyolefin in the dielectric material. Other amounts may be selected as suitable for the intended cable configuration. The dielectric material can include $Sb_2O_3$ in amount of at least 10 parts by weight, at least 12 parts by weight, or even at least 14 parts by weight, relative to 100 parts by weight of polyolefin in the dielectric material. In some embodiments, the dielectric material can include an amount of $Sb_2O_3$ in a range from 12 parts by weight to 20 parts by weight, from 12 parts by weight to 18 parts by weight, or even from 12 parts by weight to 16 parts by weight relative to 100 parts by weight of polyolefin in the dielectric material.

In some embodiments, a weight ratio of the brominated flame retardant material to the $Sb_2O_3$ is in a range from 1.5 to 3.5, from 1.5 to 3.0, from 1.5 to 2.5, or even from 1.5 to 2.0. Surprisingly, a ratio of brominated flame retardant material to $Sb_2O_3$ as low as 1.5 was found to be suitable for making a cable of the present disclosure that can pass the VW-1 flame test.

In any of the above compositions of dielectric material, additives may be optionally included depending on the intended application, e.g., additives to promote melt flow during e.g, the cable insulation extrusion process.

In FIG. 1 an exemplary shielded electrical cable 2 is shown that includes a plurality of conductor sets 4 spaced apart from each other along all or a portion of a width, w, of the cable 2 and extend along a length, L, of the cable 2. The cable 2 may be arranged generally in a planar configuration as illustrated in FIG. 1 or may be folded at one or more places along its length into a folded configuration. In some implementations, some parts of cable 2 may be arranged in a planar configuration and other parts of the cable may be folded. In some configurations, at least one of the conductor sets 4 of the cable 2 includes two insulated conductors 6 extending along a length, L, of cable 2. The two insulated conductors 6 of the conductor sets 4 may be arranged substantially parallel along all or a portion of the length, L, of the cable 2. Insulated conductors 6 may include insulated signal wires, insulated power wires, or insulated ground wires. Two shielding films 8 are disposed on opposite sides of the cable 2.

The first and second shielding films 8 are arranged so that, in transverse cross section, cable 2 includes cover regions 14 and pinched regions 18. In the cover regions 14 of the cable 2, cover portions 7 of the first and second shielding films 8 in transverse cross section substantially surround each conductor set 4. For example, cover portions of the shielding films may collectively encompass at least 75%, or at least 80, 85, or 90% of the perimeter of any given conductor set. Pinched portions 9 of the first and second shielding films form the pinched regions 18 of cable 2 on each side of each conductor set 4. In the pinched regions 18 of the cable 2, one or both of the shielding films 8 are deflected, bringing the pinched portions 9 of the shielding films 8 into closer proximity. In some configurations, as illustrated in FIG. 1, both of the shielding films 8 are deflected in the pinched regions 18 to bring the pinched portions 9 into closer proximity. In some configurations, one of the shielding films may remain relatively flat in the pinched regions 18 when the cable is in a planar or unfolded configuration, and the other shielding film on the opposite side of the cable may be deflected to bring the pinched portions of the shielding film into closer proximity.

The cable 2 may also include an adhesive layer 10 disposed between shielding films 8 at least between the pinched portions 9. The adhesive layer 10 bonds the pinched portions 9 of the shielding films 8 to each other in the pinched regions 18 of the cable 2. The adhesive layer 10 may or may not be present in the cover region 14 of the cable 2.

In some cases, conductor sets 4 have a substantially curvilinearly-shaped envelope or perimeter in transverse cross-section, and shielding films 8 are disposed around conductor sets 4 such as to substantially conform to and maintain the cross-sectional shape along at least part of, and preferably along substantially all of, the length L of the cable 6. Maintaining the cross-sectional shape maintains the electrical characteristics of conductor sets 4 as intended in the design of conductor sets 4. This is an advantage over some conventional shielded electrical cables where disposing a conductive shield around a conductor set changes the cross-sectional shape of the conductor set.

Although in the embodiment illustrated in FIG. 1, each conductor set 4 has exactly two insulated conductors 6, in other embodiments, some or all of the conductor sets may include only one insulated conductor, or may include more than two insulated conductors 6. For example, an alternative shielded electrical cable similar in design to that of FIG. 1 may include one conductor set that has eight insulated conductors 6, or eight conductor sets each having only one insulated conductor 6. This flexibility in arrangements of conductor sets and insulated conductors allows the disclosed shielded electrical cables to be configured in ways that are suitable for a wide variety of intended applications. For example, the conductor sets and insulated conductors may be configured to form: a multiple twinaxial cable, i.e., multiple conductor sets each having two insulated conductors; a multiple coaxial cable, i.e., multiple conductor sets each having only one insulated conductor; or combinations thereof. In some embodiments, a conductor set may further include a conductive shield (not shown) disposed around the one or more insulated conductors, and an insulative jacket (not shown) disposed around the conductive shield.

In the embodiment illustrated in FIG. 1, shielded electrical cable 2 further includes optional ground conductors 12. Ground conductors 12 may include ground wires or drain wires. Ground conductors 12 can be spaced apart from and extend in substantially the same direction as insulated conductors 6. Shielding films 8 can be disposed around ground conductors 12. The adhesive layer 10 may bond shielding films 8 to each other in the pinched portions 9 on both sides of ground conductors 12. Ground conductors 12 may electrically contact at least one of the shielding films 8.

Figure 2:
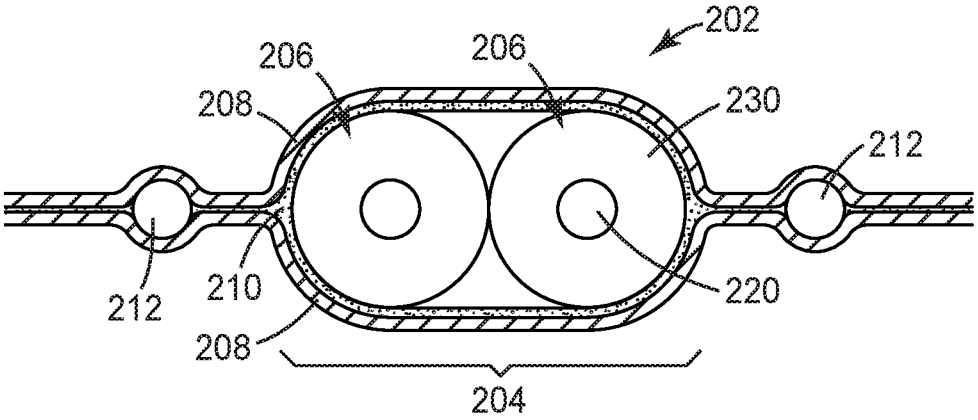
FIG. 2 is a front cross-sectional view of another exemplary embodiment of a shielded electrical cable according to an aspect of the present disclosure.

Referring to FIG. 2, shielded electrical cable 202 includes, among a plurality of conductor sets, single conductor set 204 (other conductor sets in cable 202 not shown). Conductor set 204 includes two longitudinal insulated conductors 206. Each insulated conductor 206 includes a central conductor 220 surrounded by a dielectric material 230. Two generally parallel shielding films 208 are disposed around conductor set 204. A conformable adhesive layer 210 is disposed between shielding films 208 and bonds shielding films 208 to each other on both sides of conductor set 204. Shielded electrical cable 202 further includes optional longitudinal ground conductors 212. Ground conductors 212 are spaced apart from and extend in substantially the same direction as insulated conductors 206. Conductor set 204 and ground conductors 212 are arranged generally in a single plane. Shielding films 208 are disposed around ground conductors 212 and conformable adhesive layer 210 bonds shielding films 208 to each other on both sides of ground conductors 212. Ground conductors 212 may electrically contact at least one of shielding films 208. Insulated conductors 206 are arranged generally in a single plane and effectively in a twinaxial or differential pair cable arrangement.

Figure 3:
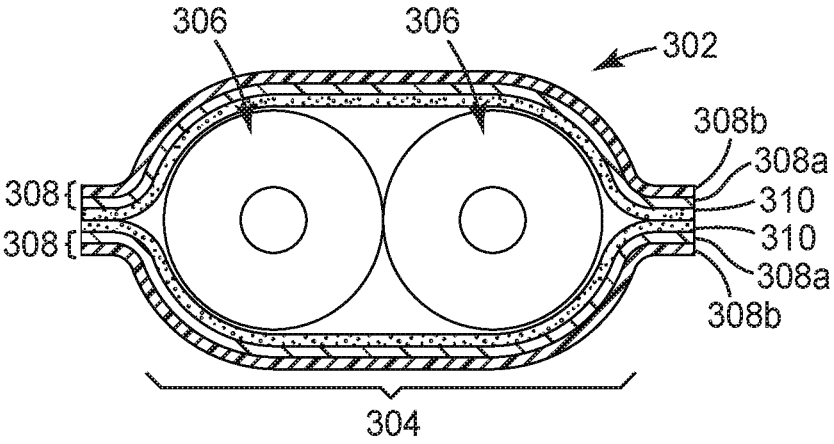
FIG. 3 is a front cross-sectional view of another exemplary embodiment of a shielded electrical cable according to an aspect of the present disclosure.

Referring to FIG. 3, shielded electrical cable 302 includes, among a plurality of conductor sets, a single conductor set 304 (other conductor sets in cable 302 not shown). Conductor set 304 includes two substantially parallel longitudinal insulated conductors 306. Two generally parallel shielding films 308 are disposed around conductor set 304. Shielding films 308 include a conformable adhesive layer 310 that bonds shielding films 308 to each other on both sides of conductor set 304. Insulated conductors 306 are arranged generally in a single plane and effectively in a twinaxial or differential pair cable arrangement. Shielding films 308 include a conductive layer 308*a* and a non-conductive polymeric layer 308*b*. Conductive layer 308*a* faces insulated conductors 306. In an alternate configuration (not shown), non-conductive polymeric layer 308*b* can face insulated conductors 306. Conductive layer 308*a* may be deposited onto non-conductive polymeric layer 308*b* using any suitable method.

Figure 4:
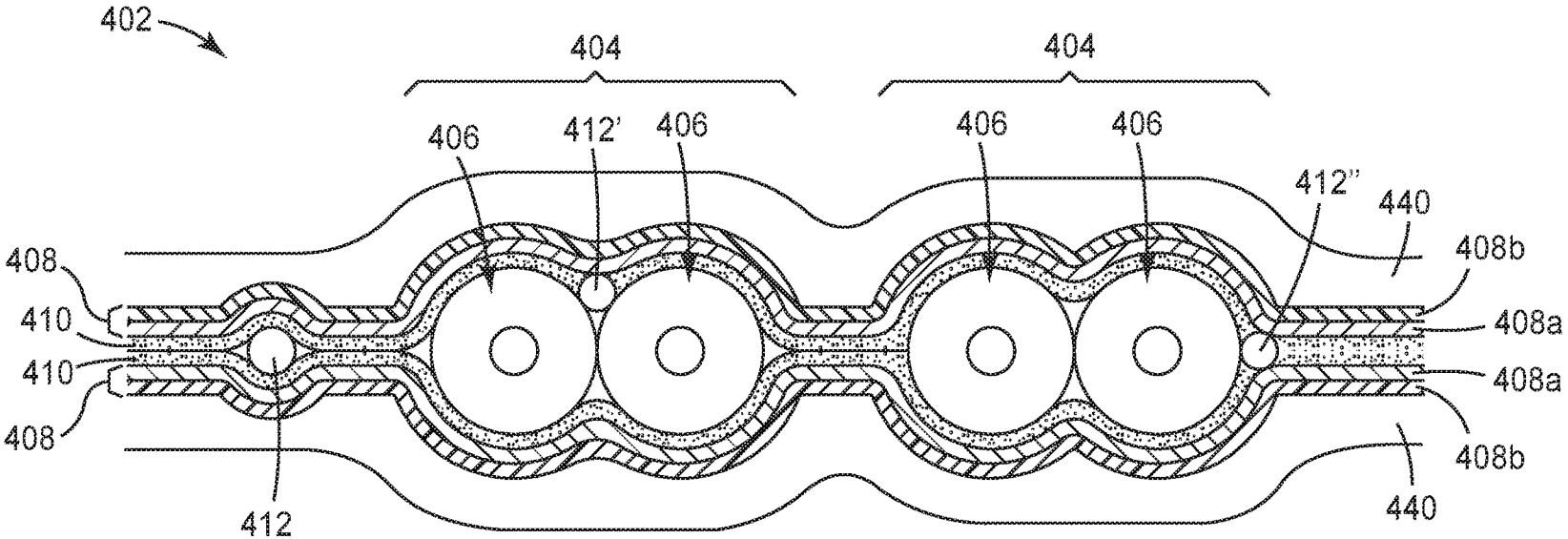
FIG. 4 is a front cross-sectional view of another exemplary embodiment of a shielded electrical cable according to an aspect of the present disclosure.

Referring to FIG. 4, shielded electrical cable 402 includes a plurality of conductor sets 404. Each conductor set 404 includes two substantially parallel longitudinal insulated conductors 406. Two generally parallel shielding films 408 are disposed around conductor sets 404. Shielding films 408 include a conformable adhesive layer 410 that bonds shielding films 408 to each other on both sides of conductor sets 404. Insulated conductors 406 are arranged generally in a single plane and effectively in a twinaxial or differential pair cable arrangement. Shielding films 408 include a conductive layer 408*a* and a non-conductive polymeric layer 408*b*. Conductive layer 408*a* faces insulated conductors 406. In an alternate configuration (not shown), non-conductive polymeric layer 408*b* can face insulated conductors 406. Conductive layer 408*a* may be deposited onto non-conductive polymeric layer 408*b* using any suitable method.

Shielded electrical cable 402 further includes longitudinal ground conductors (i.e., drain ground wires) 412, 412', and 412", any of which is optional. Ground conductors 412, 412', and 412" extend in substantially the same direction as insulated conductors 406. Conductor set 404 and ground conductors 412, 412', and 412" are arranged generally in a single plane. Shielding films 408 are disposed around ground conductors 412 and conformable adhesive layer 410 bonds shielding films 408 to each other on both sides of ground conductors 412. Ground conductors may electrically contact at least one of shielding films 408. For example, in cable 402, ground conductors 412' and 412" each electrically contact layer 408*a* of at least one shielding film 408.

The shielded electrical cable of the present disclosure can include various arrangements of ground conductors. For example, each conductor set in the shielded electrical cable can further includes one or more drain ground wires extending along the length of the cable and in capacitive contact with at least one of the conductive shielding films of the conductor set. The term "in capacitive contact with" refers to a configuration where a dielectric material is between the drain ground wire and the conductive shielding film, as is the case for drain ground wire 412 (with conformable adhesive 410 serving as a dielectric material). Alternatively, each conductor set in the shielded electrical cable can further includes one or more drain ground wires extending along the length of the cable and in resistive contact with at least one of the conductive shielding films of the conductor set, as is the case for drain ground wires 412' and 412". A drain ground wire can also be disposed between two insulated conductors, as is shown for drain ground wire 412', which is disposed between the insulated conductors 406 in a conductor set 404.

Shielded electrical cable 402 is shown as including an insulating jacket 440. Insulating jacket 440 covers the pair of conductive shielding films 408.

The shielding films used in the disclosed shielded cables can have a variety of configurations and be made in a variety of ways. In some cases, one or more shielding films may include a conductive layer and a non-conductive polymeric layer. The conductive layer may include any suitable conductive material, including but not limited to copper, silver, aluminum, gold, and alloys thereof. The non-conductive polymeric layer may include any suitable polymeric material, including but not limited to polyester, polyimide, polyamide-imide, polytetrafluoroethylene, polypropylene, polyethylene, polyphenylene sulfide, polyethylene naphthalate, polycarbonate, silicone rubber, ethylene propylene diene rubber, polyurethane, acrylates, silicones, natural rubber, epoxies, and synthetic rubber adhesive. The non-conductive polymeric layer may include one or more additives and/or fillers to provide properties suitable for the intended application. In some cases, at least one of the shielding films may include a laminating adhesive layer disposed between the conductive layer and the non-conductive polymeric layer. For shielding films that have a conductive layer disposed on a non-conductive layer, or that otherwise have one major exterior surface that is electrically conductive and an opposite major exterior surface that is substantially non-conductive, the shielding film may be incorporated into the shielded cable in several different orientations as desired. In some cases, for example, the conductive surface may face the conductor sets of insulated wires and ground wires, and in some cases the non-conductive surface may face those components. In cases where two shielding films are used on opposite sides of the cable, the films may be oriented such that their conductive surfaces face each other and each face the conductor sets and ground wires, or they may be oriented such that their non-conductive surfaces face each other and each face the conductor sets and ground wires, or they may be oriented such that the conductive surface of one shielding film faces the conductor sets and ground wires, while the non-conductive surface of the other shielding film faces conductor sets and ground wires from the other side of the cable.

In some cases, at least one of the shielding films may be or include a stand-alone conductive film, such as a compliant or flexible metal foil. The construction of the shielding films may be selected based on a number of design parameters suitable for the intended application, such as, e.g., flexibility, electrical performance, and configuration of the shielded electrical cable (such as, e.g., presence and location of ground conductors). In some cases, the shielding films may have an integrally formed construction. In some cases, the shielding films may have a thickness in the range of 0.01 mm to 0.05 mm. The shielding films desirably provide isolation, shielding, and precise spacing between the conductor sets, and allow for a more automated and lower cost cable manufacturing process. In addition, the shielding films prevent a phenomenon known as "signal suck-out" or resonance, whereby high signal attenuation occurs at a particular frequency range. This phenomenon typically occurs in conventional shielded electrical cables where a conductive shield is wrapped around a conductor set.

Referring again to FIG. 1, conformable adhesive layer 10 of shielded electrical cable 2 is disposed between shielding films 8 and bonds shielding films 8 to each other on both sides of each conductor set 4. In one embodiment, conformable adhesive layer 10 may be disposed on one of shielding films 8. In another embodiment, conformable adhesive layer 10 may be disposed on both shielding films 8. Conformable adhesive layer 10 may include an insulative adhesive and provide an insulative bond between shielding films 8. Optionally, conformable adhesive layer 10 may provide an insulative bond between at least one of shielding films 8 and insulated conductors 6, and between at least one of shielding films 8 and ground conductors 12. Conformable adhesive layer 10 may include a conductive adhesive and provide a conductive bond between shielding films 8. Optionally, conformable adhesive layer 10 may provide a conductive bond between at least one of shielding films 8 and ground conductors 12. Suitable conductive adhesives include conductive particles to provide the flow of electrical current. The conductive particles can be any of the types of particles currently used, such as spheres, flakes, rods, cubes, amorphous, or other particle shapes. They may be solid or substantially solid particles such as carbon black, carbon fibers, nickel spheres, nickel coated copper spheres, metal-coated oxides, metal-coated polymer fibers, or other similar conductive particles. These conductive particles can be made from electrically insulating materials that are plated or coated with a conductive material such as silver, aluminum, nickel, or indium tin-oxide. The metal-coated insulating material can be substantially hollow particles such as hollow glass spheres, or may comprise solid materials such as glass beads or metal oxides. The conductive particles may be on the order of several tens of microns to nanometer sized materials such as carbon nanotubes. Suitable conductive adhesives may also include a conductive polymeric matrix. In one aspect, conformable adhesive layer 10 may include a continuous adhesive layer extending along the entire length and width of shielding films 8. In another aspect, conformable adhesive layer 10 may include a discontinuous adhesive layer. For example, conformable adhesive layer 10 may be present only in some portions along the length or width of shielding films 8. In one embodiment, discontinuous adhesive layer 10 includes a plurality of longitudinal adhesive stripes that are disposed, e.g., on both sides of each conductor set 4 and ground conductors 12. In one embodiment, conformable adhesive layer 10 includes at least one of a pressure sensitive adhesive, a hot melt adhesive, a thermoset adhesive, and a curable adhesive. In one embodiment, conformable adhesive layer 10 is configured to provide a bond between shielding films 8 that is substantially stronger than a bond between one or more insulated conductor 6 and shielding films 8. This may be achieved, e.g., by selecting the adhesive formulation accordingly. An advantage of this adhesive configuration is that shielding films 8 are readily strippable from the insulation of insulated conductors 6. In another embodiment, conformable adhesive layer 10 is configured to provide a bond between shielding films 8 and a bond between one or more insulated conductor 6 and shielding films 8 that are substantially equally strong. An advantage of this adhesive configuration is that insulated conductors 6 are anchored between shielding films 8. On bending shielded electrical cable 2, this allows for little relative movement and therefore reduces the likelihood of buckling of shielding films 8. Suitable bond strengths may be chosen based on the intended application. In one embodiment, conformable adhesive layer 10 has a thickness of less than about 0.13 mm. In a preferred embodiment, conformable adhesive layer 10 has a thickness of less than about 0.05 mm.

Conformable adhesive layer 10 may conform to achieve desired mechanical and electrical performance characteristics of shielded electrical cable 2. In one aspect, conformable adhesive layer 10 may conform to be thinner between shielding films 8 in areas between conductor sets 4, thereby increasing at least the lateral flexibility of shielded electrical cable 2. This allows shielded electrical cable 2 to be placed more easily into a curvilinear outer jacket. In another aspect, conformable adhesive layer 10 may conform to be thicker in areas immediately adjacent conductor sets 4 and substantially conform to conductor sets 4. This increases the mechanical strength and enables forming a curvilinear shape of shielding films 8 in these areas, which increases the durability of shielded electrical cable 2 (e.g., during flexing of the cable). In addition, this helps to maintain the position and spacing of insulated conductors 6 relative to shielding films 8 along the length of shielded electrical cable 2, which results in uniform impedance and superior signal integrity of shielded electrical cable 2. In another aspect, conformable adhesive layer 10 may conform to effectively be partially of completely removed between shielding films 8 in areas between conductor sets 4. As a result, shielding films 8 electrically contact each other in these areas, thereby increasing the electrical performance of shielded electrical cable 2. In another aspect, conformable adhesive layer 10 may conform to effectively be partially (or completely) removed between at least one of shielding films 8 and ground conductors 12. As a result, ground conductors 12 electrically contact at least one of shielding films 8 in these areas, which increases the electrical performance of shielded electrical cable 2. Even if a thin conformable adhesive layer 10 exists between at least one of shielding films 8 and ground conductors 12, asperities on ground conductors 12 may break through conformable adhesive layer 10 to establish electrical contact as intended.

Insulated conductor 6 includes a central conductor (see, e.g., central conductor 220 in insulated conductor 206 in cable 202). The central conductor of each insulated conductor in the plurality of conductor sets is a wire, having a wire diameter of not greater than 20 AWG. In some embodiments, the central conductor has a wire diameter of not greater than 21 AWG, not greater than 22 AWG, not greater than 23 AWG, not greater than 24 AWG, not greater than 25 AWG, not greater than 26 AWG, not greater than 27 AWG, not greater than 28 AWG, or even not greater than 29 AWG (e.g., 30 AWG). The wire can be any of copper wire, aluminum wire, silver wire, silver plated copper wire, or tin plated copper wire.

In some embodiments, the insulated conductor of each conductor set in the plurality of conductor sets has a nominal characteristic impedance in a range of 40 ohms to 60 ohms, from 45 ohms to 55 ohms, from 70 ohms to 110 ohms, or even from 80 ohms to 100 ohms.

Item 1 is a cable comprising:

a plurality of conductor sets, each conductor set extending along a length of the cable and comprising: two or more insulated conductors, each insulated conductor comprising a central conductor surrounded by a dielectric material; first and second conductive shielding films disposed on opposite first and second sides of the conductor set, the first and second conductive shielding films including cover portions and pinched portions arranged such that, in transverse cross section, the cover portions of the first and second shielding films in combination substantially surround the conductor set, and the pinched portions of the first and second shielding films in combination form pinched portions of the conductor set on each side of the conductor set; and an adhesive layer bonding the first shielding film to the second shielding film in the pinched portions of the conductor set, wherein the dielectric material comprises: 100 parts by weight of polyolefin; 18 to 40 parts by weight of a brominated flame retardant selected from the group consisting of decabromodiphenylethane, N,N'-ethylene-bis(tetrabromophthalimide), poly(pentabromobenzyl acrylate), and mixtures thereof; and 12 to 20 parts by weight of antimony trioxide.

Item 2 is a cable according to item 1, wherein each conductor set further comprises an insulating jacket covering the first and second conductive shielding films.

Item 3 is a cable according to item 1 or item 2, wherein each conductor set extends along the entire length of the cable.

Item 4 is a cable according to any one of items 1 to 3, wherein a wire diameter of each insulated conductor of each conductor set in the plurality of conductor sets is not greater than 20 AWG.

Item 5 is a cable according to any one of items 1 to 4, wherein each insulated conductor of each conductor set in the plurality of conductor sets has a nominal characteristic impedance in a range of 40-60 ohms.

Item 6 is a cable according to any one of items 1 to 5, wherein each conductor set further includes one or more drain ground wires extending along the length of the cable and in capacitive contact with at least one of the first and second conductive shielding films of the conductor set.

Item 7 is a cable according to item 6, wherein at least one drain ground wire in the one or more drain wires is disposed between two insulated conductors.

Item 8 is a cable according to any one of items 1 to 7, further comprising one or more drain ground wires disposed between the conductor sets.

Item 9 is a cable according to any one of items 1 to 8, wherein the first and second conductive shielding films comprise at least one of copper, aluminum, and silver.

Item 10 is a cable according to any one of items 1 to 9, wherein the cover portions of the first and second shielding films of each conductor set in combination substantially surround the conductor set by encompassing at least 70% of a periphery of each conductor set.

Item 11 is a cable according to any one of items 1 to 10, wherein a weight ratio of the brominated flame retardant and the antimony trioxide is in a range from about 1.5 to about 3.0.

Item 12 is a cable according to any one of items 1 to 11, wherein the brominated flame retardant is decabromodiphenylethane.

Item 13 is a cable according to any one of items 1 to 12, wherein said polyolefin is selected from the group consisting of propylene/ethylene copolymer, 1-hexene/ethylene copolymer, and blends thereof.

EXAMPLES

Test Methods

Burning Characteristics Test Method

Burning characteristics of cable were determined according to the FV-2/VW-1 test method, Section 9.4 in UL Standards for Safety for Wire and Cable Test Methods, UL 2556, Second Edition, dated Jul. 19, 2007. Cable test samples were 1 meter long. Flame was applied to each of three samples for 15 seconds and removed and this was repeated for a total of five applications. Those samples which ceased to flame within 60 seconds, with which the absorbent cotton placed below was not ignited by droppings, and which did not burn or scorch the kraft paper placed above were assumed to be acceptable. If even one of the five samples failed to reach the acceptable level, that example was assumed to fail the test. Results were reported as either Pass or Fail.

Insertion Loss Test Method

Figure 5:
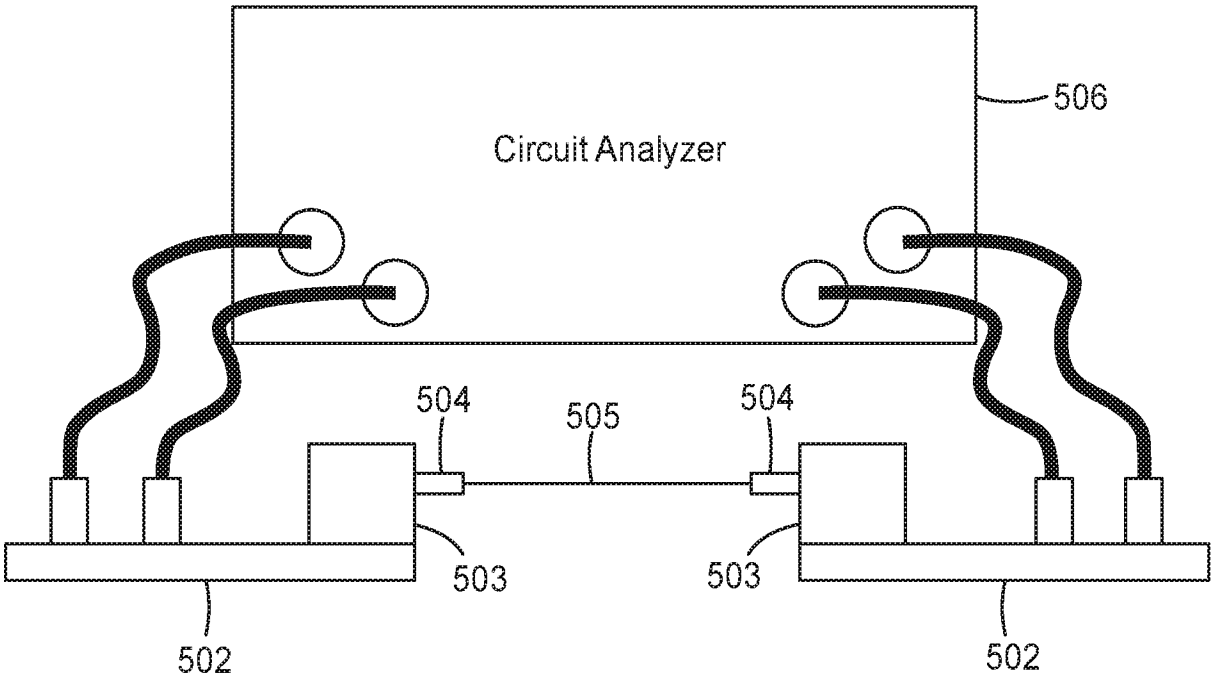
FIG. 5 is a schematic view of a set up used to test exemplary embodiments of a shielded electrical cable according to aspects of the present disclosure.

Insertion Loss was measured using the test set up as shown in FIG. 5. Referring to FIG. 5, both ends of cable test samples 505, having a length of about 1 meter, were soldered to test paddle cards 504. Mating pads on the paddle cards 504 were compliant to SFF-8086 to facilitate the connection with MiniSAS board mount connectors 503. MiniSAS board mount connectors 503 were attached to test adapter PC board assemblies 502. Test adapter PC board assemblies 502 were connected to a circuit analyzer 506, available from Agilent Technologies, Santa Clara, Calif., U.S.A., under the trade designation 43.5 GHz 4-PORT PNA-X NETWORK ANALYZER, by 3.5 mm SMA connectors. S-parameters of the cables were tested during a first test sequence using circuit analyzer 506. Test paddle cards 504 and PC board assemblies 502 were not de-embedded from the measurements. Measurements were taken of four differential signal pairs of different cable test samples 505. The results are shown in Table 3.

Impedance Test Method

The impedance was measured using a time domain reflectometer (TDR, Model CSA8000 available from Tektronic Inc, Beaverton, Oreg.) at a rise time of 35 ps, All cables were measured in one meter length.

Materials

| Material name | Description |
|---|---|
| PRO-FAX EP315J | propylene/ethylene copolymer, including up to 5% of stabilizers, obtained from LyondellBasell Industries, Houston, TX, under the trade designation "PRO-FAX EP315J" |
| DGDL 3364 NT | high density polyethylene/1-hexene copolymer, obtained from The Dow Chemical Company, Midland, MI under the trade designation "DGDL 3364 NT" |
| DGDE-1430 NT | high density polyethylene/1-hexene copolymer that includes nominally 32 phr (21 weight percent relative to a total weight of the composition) decabromodiphenylethane and 20 phr (13 weight percent relative to a total weight of the composition) antimony |

-continued

| Material name | Description |
|---|---|
| | trioxide, obtained from The Dow Chemical Company, Midland, MI |
| Wire | Wire: 30 AWG solid silver plated copper wire having a wire/insulation diameter of 0.25/0.79 mm |
| Conductive shielding film | Conductive shielding film: Construction: a layer of polyethylene terephthalate (PET) 0.48 mil (12 micrometers), a layer of polyurethane adhesive 3 micrometers adhering the PET layer to a layer of aluminum 0.285 mil (7.24 micrometers), and a layer of hot melt adhesive 1 mil (25 micrometers) on the layer of aluminum. |
| DBDPE | Decabromodiphenylethane, obtained from Chemtura, West Lafayette, IN, U.S.A. |
| EBTBP | N,N'-Ethylenebis(tetrabromophthalimide), obtained from Albemarle, Baton Rouge, LA, U.S.A. |
| Poly-PBBA | Poly(pentabromobenzyl acrylate), average molecular weight 600000, obtained from ICL-IP, St. Louis, MO, U.S.A. |

Examples 1 to 3 and Comparative Examples CE1 to CE3

The DGDE-1430 NT material (containing an ethylene/1-hexene copolymer combined with decabromodiphenylethane and $Sb_2O_3$) was assigned as dielectric material DM1. Dielectric materials DM2 to DM7 were prepared by blending DGDE-1430 NT with DGDL 3364 NT (an ethylene/1-hexene copolymer) or with PRO-FAX EP315J (a propylene/hexane copolymer) in the parts by weight indicated in Table 1. The blending was done by mixing the two polymer resins in a resin mixer before charging the mixture into the extruder barrel.

TABLE 1

| Sample | DGDE-1430 NT, parts by weight | DGDL 3364 NT, parts by weight | PRO-FAX EP315J, parts by weight |
|---|---|---|---|
| DM1 | 100 | 0 | 0 |
| DM2 | 70 | 30 | 0 |
| DM3 | 60 | 40 | 0 |
| DM4 | 70 | 0 | 30 |
| DM5 | 60 | 0 | 40 |
| DM6 | 50 | 50 | 0 |
| DM7 | 50 | 0 | 50 |

For each of DM1 to DM7, the parts by weight values for polyolefin component totaled to 100 phr. The values for DM1 were estimated based on XRF measurement. The values for DM2-DM6 were calculated based on the estimated values for DM1. The polyolefin component in each of DM2, DM3, and DM6 was a blend of ethylene/1-hexane copolymer coming from the two sources shown in Table 1 (i.e., DGDE-1430 NT and DGDL3364 NT), and since DGDE-1430 NT was the source of the DBDPE and $Sb_2O_3$ components in the resulting blends, the phr values of those components were calculated and reported as shown in Table 2. Similarly, the polyolefin component in each of DM4, DM5, and DM7 was a blend of the ethylene/1-hexane copolymer and propylene/ethylene copolymer sources shown in Table 1 (i.e., DGDE-1430 NT and PRO-FAX EP315J), and the phr values of the DBDPE and $Sb_2O_3$ components were also calculated and reported as shown in Table 2.

TABLE 2

| | Component, parts by weight per 100 parts by weight polyolefin | | | |
|---|---|---|---|---|
| Sample | ethylene/ 1-hexane copolymer | propylene/ ethylene copolymer | DBDPE | $Sb_2O_3$ |
| DM1 | 100 | 0 | 32 | 20 |
| DM2 | 100 | 0 | 22 | 14 |
| DM3 | 100 | 0 | 19 | 12 |
| DM4 | 70 | 30 | 22 | 14 |
| DM5 | 60 | 40 | 19 | 12 |
| DM6 | 100 | 0 | 16 | 10 |
| DM7 | 50 | 50 | 16 | 10 |

Cable samples based on each of the dielectric materials DM1 to DM7 were prepared in the following way. For each of the dielectric materials (i.e., each one of DM1 to DM7), insulated conductors were formed by coating the dielectric material onto wire using a pressure-type wire coating die. Sections of each insulated conductor (1 meter lengths) so produced were combined into a cable format that included from left to right in a cross-sectional view and pressed between two layers of conductive shielding film: a) a ground wire 30 AWG solid tin plated copper wire, b) 2 signal pairs of insulated conductors 30 AWG solid silver plated copper wire having a wire/insulation diameter of 0.25/0.79 mm, c) 1 set of 4 auxiliary signal lines of insulated 30 AWG tin plated solid copper wire having a wire/insulation diameter of 0.25/0.56 mm, d) 2 signal pairs of insulated conductors 30 AWG solid silver plated copper wire having a wire/insulation diameter of 0.25/0.79 mm, and e) a ground wire 30 AWG solid tin plated copper wire. The two layers of conductive shielding film each included a layer of polyethylene terephthalate (PET) 0.48 mil (12 micrometers), a layer of polyurethane adhesive 3 micrometers adhering the PET layer to a layer of aluminum 0.285 mil (7.24 micrometers), and a layer of hot melt adhesive 1 mil (25 micrometers) on the layer of aluminum.

The cable samples for Examples 1 to 4 (Ex. 1 to Ex. 4) and comparative examples CE1 to CE3 were tested for burning characteristics according to the FV-2/VW-1 test method, and the results (Pass or Fail) are listed in Table 3.

TABLE 3

| Cable Sample | Dielectric Material | VW-1 Result | Insertion Loss @ 6 GHz | Impedance (ohm) |
|---|---|---|---|---|
| CE1 | DM1 | Pass | −8.03 | 92 |
| Ex. 1 | DM2 | Pass | −7.30 | 92.7 |
| Ex. 2 | DM3 | Pass | −7.05 | 93.5 |
| Ex. 3 | DM4 | Pass | −7.38 | 93.5 |
| Ex. 4 | DM5 | Pass | ND | ND |
| CE2 | DM6 | Fail | ND | ND |
| CE3 | DM7 | Fail | −7.01 | 96.3 |

Dielectric materials DM8 to DM10 were prepared by combining samples of PRO-FAX EP315J (a propylene/hexane copolymer) with one of the brominated materials DBDPE, EBTBP, or Poly-PBBA, and $Sb_2O_3$, in the amounts shown in Table 4 (the amounts of the various components are expressed in parts by weight per 100 parts by weight of polyolefin component).

TABLE 4

| Sample | PRO-FAX EP315J, parts by weight | Brominated Compound | Brominated Compound, parts by weight | $Sb_2O_3$, parts by weight |
|---|---|---|---|---|
| DM8 | 100 | DBDPE | 36 | 12 |
| DM9 | 100 | EBTBP | 36 | 12 |
| DM10 | 100 | Poly-PBBA | 36 | 12 |

Illustrative examples of cables based on each of the dielectric materials DM8 to DM10 were prepared in the following way. A stripe of the dielectric material 0.5 inch (1.3 cm) wide and 15 mil (X micrometers) thick was embedded with four 10 mil (30 AWG) copper wires and laminated between two coverlayers. The coverlayers each included a layer of polyethylene terephthalate (PET) 0.48 mil (12 micrometers), a layer of polyurethane adhesive 3 micrometers adhering the PET layer to a layer of aluminum 0.285 mil (7.24 micrometers), and a layer of hot melt adhesive 1 mil (25 micrometers) on the layer of aluminum. A comparative example CE4 was also prepared, using PRO-FAX EP315J without the addition of brominated compound or $Sb_2O_3$. The cable test samples (Illustrative Examples IE1 to IE3 and comparative example CE4) were tested for burning characteristics according to the FV-2/VW-1 test method, and the results (Pass or Fail) are listed in Table 5.

TABLE 5

| Illustrative Example | Dielectric Material | VW-1 Result |
|---|---|---|
| IE1 | DM8 | Pass |
| IE2 | DM9 | Pass |
| IE3 | DM10 | Pass |
| CE4 | PRO-FAX EP315J | Fail |

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the mechanical, electro-mechanical, and electrical arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A cable comprising:

a plurality of conductor sets, each conductor set extending along a length of the cable and comprising:

two or more insulated conductors, each insulated conductor comprising a central conductor surrounded by a dielectric material;

first and second conductive shielding films disposed on opposite first and second sides of the conductor set, the first and second conductive shielding films including cover portions and pinched portions arranged such that, in transverse cross section, the cover portions of the first and second shielding films in combination substantially surround the conductor set, and the pinched portions of the first and second shielding films in combination form pinched portions of the conductor set on each side of the conductor set; and an adhesive layer bonding the first shielding film to the second shielding film in the pinched portions of the conductor set, wherein the dielectric material comprises:

100 parts by weight of polyolefin;

18 to 40 parts by weight of a brominated flame retardant selected from a group consisting of decabromodiphenylethane, N,N'-ethylene-bis(tetrabromophthalimide), poly(pentabromobenzyl acrylate), and mixtures thereof; and 12 to 20 parts by weight of antimony trioxide.

2. The cable of claim 1, wherein each conductor set further comprises an insulating jacket covering the first and second conductive shielding films.

3. The cable of claim 1, wherein each conductor set extends along the entire length of the cable.

4. The cable of claim 1, wherein a wire diameter of each insulated conductor of each conductor set in the plurality of conductor sets is not greater than 20 AWG.

5. The cable of claim 1, wherein each insulated conductor of each conductor set in the plurality of conductor sets has a nominal characteristic impedance in a range of 40-60 ohms.

6. The cable of claim 1, wherein each conductor set further includes one or more drain ground wires extending along the length of the cable and in capacitive contact with at least one of the first and second conductive shielding films of the conductor set.

7. The cable of claim 6, wherein at least one drain ground wire in the one or more drain wires is disposed between two insulated conductors.

8. The cable of claim 1 further comprising one or more drain ground wires disposed between the conductor sets.

9. The cable of claim 1, wherein the first and second conductive shielding films comprise at least one of copper, aluminum, and silver.

10. The cable of claim 1, wherein the cover portions of the first and second shielding films of each conductor set in combination substantially surround the conductor set by encompassing at least 70% of a periphery of each conductor set.

11. The cable of claim 1, wherein a weight ratio of the brominated flame retardant and the antimony trioxide is in a range from about 1.5 to about 3.5.

12. The cable of claim 1, wherein the brominated flame retardant is decabromodiphenylethane.

13. The cable of claim 1, wherein said polyolefin is selected from a group consisting of propylene/ethylene copolymer, 1-hexene/ethylene copolymer, and blends thereof.

* * * * *